US008569668B2

(12) United States Patent
Chirivella et al.

(10) Patent No.: US 8,569,668 B2
(45) **Date of Patent: *Oct. 29, 2013**

(54) ACTIVE VORTEX CONTROL SYSTEM (AVOCS) AND METHOD FOR ISOLATION OF SENSITIVE COMPONENTS FROM EXTERNAL ENVIRONMENTS

(75) Inventors: Jose E. Chirivella, Tucson, AZ (US); Anton VanderWyst, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 246 days.

This patent is subject to a terminal disclaimer.

(21) Appl. No.: 13/269,995

(22) Filed: Oct. 10, 2011

(65) Prior Publication Data

US 2013/0199618 A1 Aug. 8, 2013

Related U.S. Application Data

(63) Continuation of application No. 12/347,247, filed on Dec. 31, 2008, now Pat. No. 8,146,862.

(60) Provisional application No. 61/061,263, filed on Jun. 13, 2008.

(51) Int. Cl.
*F42B 15/08* (2006.01)

(52) U.S. Cl.
USPC ..... 244/3.16; 244/121

(58) Field of Classification Search
USPC ..... 244/3.16, 3.22, 73 R, 76 J, 121, 198, 244/199.1, 204.1, 207; 239/288, 288.3, 239/288.5, 490, 491, 492; 454/71
See application file for complete search history.

(56) References Cited

U.S. PATENT DOCUMENTS

| | | | | |
|---|---|---|---|---|
| 3,259,065 | A * | 7/1966 | Ross et al. | 244/3.1 |
| 3,508,561 | A * | 4/1970 | Cornish | 137/13 |
| 4,850,275 | A * | 7/1989 | Utreja et al. | 102/293 |
| 4,867,357 | A * | 9/1989 | Inglis et al. | 244/121 |
| 5,125,597 | A * | 6/1992 | Coffinberry | 244/118.5 |

* cited by examiner

*Primary Examiner* — Tien Dinh
*Assistant Examiner* — Michael Kreiner
(74) *Attorney, Agent, or Firm* — Eric A. Gifford

(57) ABSTRACT

An active vortex control system (AVOCS) includes a set of primary injectors that inject gas into a cavity to generate a vortex in front of and possibly around components inside the cavity. The vortex interferes with an external flow field in an opening to the cavity to protect the components from the external environment. Sets of secondary injectors may inject gas at a reduced mass flow into the cavity to compensate for energy losses to maintain the coherence of the vortex. The AVOCS is well suited for use in windowless endo- and exo-atmospheric interceptors to protect the electro-optical imagers and optical components from Earth atmosphere.

18 Claims, 8 Drawing Sheets

ACTIVE VORTEX CONTROL SYSTEM (AVOCS) AND METHOD FOR ISOLATION OF SENSITIVE COMPONENTS FROM EXTERNAL ENVIRONMENTS

CROSS-REFERENCE TO RELATED APPLICATIONS

This application claims benefit of priority under 35 U.S.C. 119(e) to U.S. Provisional Application Nos. 61/061,263 entitled "Active Vortex Cooling System (AVOCS) and Method for Isolation of Sensitive Components from External Environments" filed on Jun. 13, 2008, and to U.S. patent application Ser. No. 12/347,247 entitled "Active Vortex Cooling System (AVOCS) and Method for Isolation of Sensitive Components from External Environments" filed on Dec. 31, 2008.

BACKGROUND OF THE INVENTION

1. Field of the Invention

This invention relates to the protection of sensitive components from hostile external environments and more particularly to an active vortex control system (AVOCS) that injects gas into a cavity to generate a vortex in front of the components to interfere with external flow fields.

2. Description of the Related Art

Components such as electro-optical (EO) sensors, optics or wafers at intermediate stages of fabrication or non-EO components (exposed because of the EO requirements) can be effected by exposure to a hostile external environment. Broadly defined, a hostile external environment is any environment that could cause a change in physical or chemical properties of the components leading to a degradation of its performance e.g. contamination, heating, erosion, ocular diffraction and distortion. The environment's external flow field interacts with the component to potentially cause the degradation. The flow field may be as benign as diffusion or outgassing in a clean room under positive pressure that may contaminate the wafers or as aggressive as an air stream in an exo-atmospheric interceptor. Physical isolation of the components from the external environment may not be cost-effective or may degrade the performance of the components depending upon the application.

Missile systems use EO sensors to acquire and track targets. The ability to accurately determine the target's position and to initiate imaging early on is critical to accomplishing the mission. Endo-atmospheric missiles experience excessive thermal loads due to the free stream air density. These systems therefore require a physical cover such as a sun shade. Once the physical cover is removed, an optical "window" can be used to protect the sensitive components from the air stream while allowing the desired wavelengths of interest to pass through unaltered. The disadvantage of such windows is that they are very expensive and thermal heating causes the window's refractive index to change during flight. This change in wave index distorts the image and causes an apparent shift in position of imaged objects. In addition, to allow multiple frequencies past the window entails significant engineering mass and manufacturing challenges. The surface heating is unpredictable and cannot be effectively compensated.

As the vehicle speed increases, the shock wave in front of the interceptor superheats the air entering the cavity to an ever greater extent. However, at larger altitudes the lower atmospheric density results in a smaller total thermal footprint. At some point, current designs reach a transition point where the added watts due to thermal heating are low enough that a nose cone can be jettisoned and the EO sensors engaged without requiring an optical window or other component protection scheme. The performance, reliability and cost associated with optical windows are such that system designers choose to delay acquisition and functional tracking by several seconds to avoid their use. The task of acquiring, identifying, tracking and intercepting an incoming ballistic missile is extremely difficult. A delay of even a few seconds of engaging the target can affect the situational awareness of the battlefield. This in turn either reduces the likelihood of a successful response or requires additional assets be deployed to ensure a successful response.

SUMMARY OF THE INVENTION

The present invention provides an apparatus and method for protecting sensitive components from a hostile external environment.

This is accomplished with one or more sensitive components placed inside a cover on a platform. The cover and platform protect the components while providing an opening to an external environment. An active vortex control system (AVOCS) injects gas into the cavity defined by the cover to generate a vortex in front of and possibly around the components. The vortex interferes with any external flow fields in the opening to protect the components from the external environment.

In an embodiment, a cover is placed on the platform around the components with an opening to the external environment. Injectors inject gas into the cavity to create and maintain the coherence of the vortex as it advances towards the external flow field and is vented out of the opening. A first set of injectors may be placed along an inner periphery of the cavity and facing partially inwards to create the vortex. Additional sets of injectors may be placed along the inner periphery of the cavity towards the opening and/or placed on internal structure (components or supporting structure) to inject gas at a suitably reduced flow rate still sufficient to maintain the coherence of the advancing vortex. The rotating fluid stabilizes the flow and eliminates any random oscillations of the stagnant gas. The rotating inflow boundary conditions result in a strong solution to the Navier-Stokes equations. This addition collapses multiple potential answers from plain stagnation flow running opposite to the external flow into a single solution. These weak stagnation solutions exist even if the momentum and pressure requirements are fulfilled. The resulting strong flow stability enables the corresponding low mass injection rate.

Injectors may be placed near particular components to ensure stability of the vortex at that point to provide additional protection and/or cooling of that component. The injected gas suitably may have a greater molecular weight than that of the external flow field, but is not required as long as the linear momentum conditions are satisfied.

The AVOCS injects gas at a mass flow rate sufficient to create and maintain a vortex capable of interfering with the external flow field and keep it sufficiently away from the components. Ideally, the vortex produces a cavity pressure approximately equal to or greater than the free stream Pitot pressure of the external flow field, a linear momentum approximately equal to or greater than the momentum of the external flow field and an angular momentum sufficient to maintain coherence of the vortex. Satisfaction of all three conditions ensures that the vortex will completely block external flow fields from entering the cavity. To conserve both gas and energy the vortex may be designed and the conditions relaxed to allow the external flow fields to enter the cavity but be kept away from critical components or to enter and even reach the components but for such a brief period of time there is no damage. These different approaches can be achieved by maintaining a constant mass flow at or above a minimum required flow, regulating the mass flow to maintain a target cavity pressure or regulating the mass flow to maintain a positive pressure inside the cavity.

In another embodiment, the platform and AVOCS are mounted on an airborne launch vehicle such as a missile or interceptor. A structure such as a nose cone or shroud isolates the cavity from the external flow field during the initial stages of flight. The AVOCS injects gas to form the vortex just prior to jettisoning the structure and initiating data gathering. Generating the vortex pre-jettison protects the components from both the air stream and any jettison debris. The AVOCS concept provides effective "windowless" operation. For interceptors following a trajectory to the upper reaches of Earth atmosphere, AVOCS allows the structure to be jettisoned earlier at correspondingly lower altitudes that would otherwise damage the EO sensors.

These and other features and advantages of the invention will be apparent to those skilled in the art from the following detailed description of preferred embodiments, taken together with the accompanying drawings, in which:

DETAILED DESCRIPTION OF THE INVENTION

Figure 1:
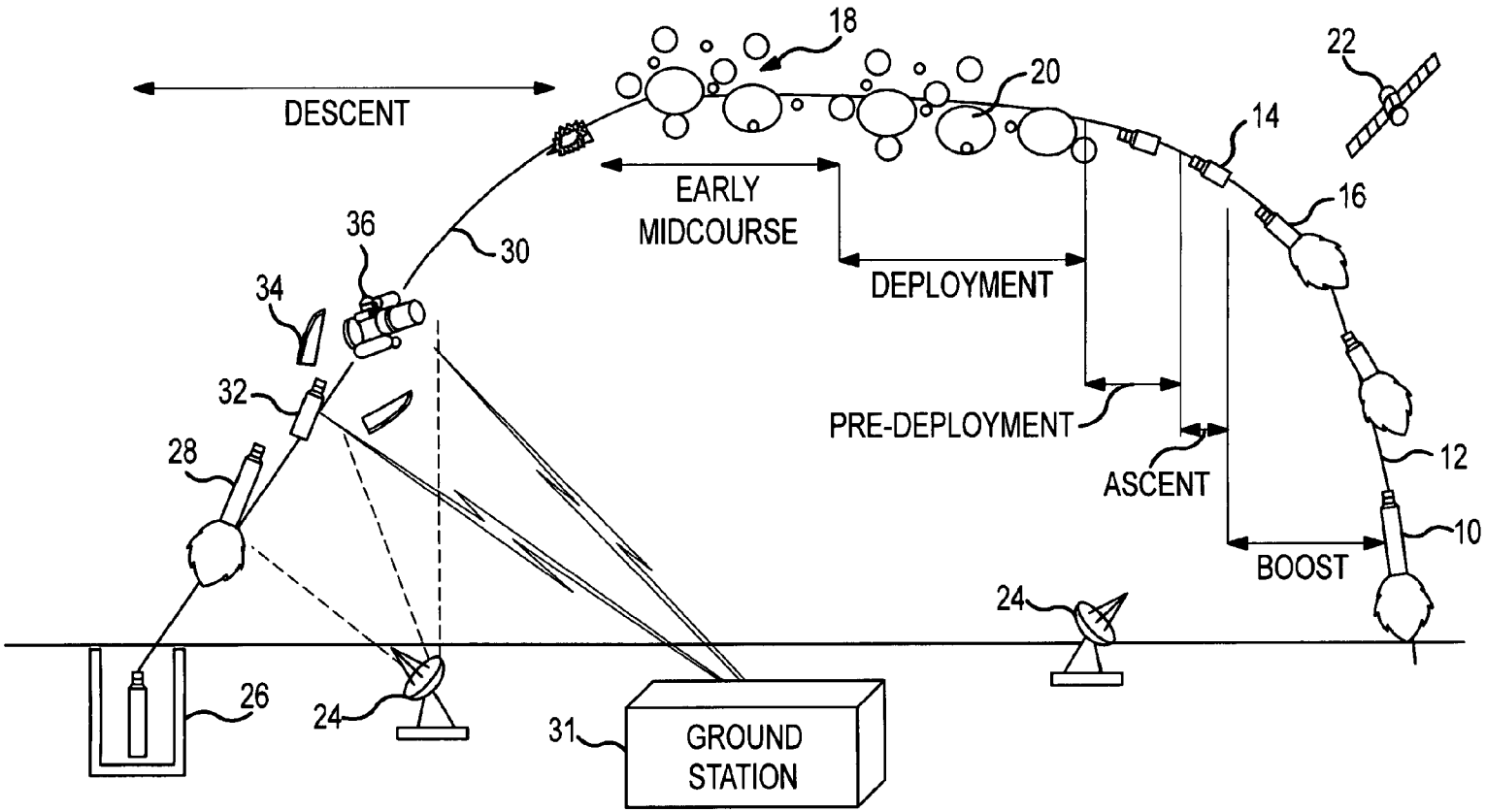
FIG. 1 is a diagram of an interceptor mission sequence in accordance with the present invention.

The present invention provides an apparatus and method for protecting sensitive components from a hostile external environment. This is accomplished with one or more sensitive components placed inside a protective cover on a platform. The cover defines a protective cavity having an opening to an external environment. An active vortex control system (AVOCS) injects gas into the cavity to generate a vortex in front of and possibly around the components that interferes with an external flow field to protect the components from the external environment. AVOCS may require no moving parts, other than possibly opening and closing flow control valves, or refrigerant. AVOCS can be used in any situation in which physically isolating the components from the external environment with a window or other structure is not desired or practical due to cost, reliability or performance. AVOCS may be used in situations where physical isolation could be effective. In general, AVOCS eliminates the requirement for an optical window to protect EO sensor components. AVOCS could conceivably also be used in conjunction with windowed systems for a variety of purposes. One example use would be to keep rain off the optical window. Without loss of generality, the AVOCS will be described in the context of an exo-atmospheric interceptor such as a unitary kill-vehicle (KV) or multiple KV system. The principles, methodology and structure of the AVOCS are also applicable to subsonic atmospheric missiles, underwater vehicles, space-based platforms, clean room environments, etc.

Raytheon Company has fielded a unitary KV system designed to locate, track and collide with a ballistic missile. The unitary interceptor constitutes a single KV and is launched on a multistage rocket booster. Current versions of the kill vehicle have large aperture optical sensors to support the terminal flight phase. These endgame functions include: acquisition of the target complex, resolution of the objects. tracking the credible objects, discrimination of the target objects and horning in on the target warhead. Raytheon is developing Multiple Kill Vehicle (mKV) systems that can deploy multiple KVs from an interceptor carrier vehicle. Depending on the configuration, the end game functions may be performed by each KV independently, by the network of KVs or in part by the carrier vehicle. In these configurations, EO sensors on-board the KV are used to image the ballistic missile and target cloud. Given the complexity of the task and extremely large closing velocities of the threat and interceptor, a key system parameter is how early in the interceptor trajectory imaging can commence. The typical windowless system must wait until the interceptor is sufficiently high, perhaps 80 km, to jettison the nose cone and initiate data acquisition with the EO sensors. The use of the AVOCS allows the flight controller to jettison the nose cone much earlier. While the exact uncap altitude can vary with the total mass released, a representative beginning at approximately 60 km provides many seconds earlier tracking response. This greatly increases the probability of acquiring and destroying the target and/or reduces the number of assets that must be deployed against a threat. AVOCS can be retrofitted to existing interceptor designs or integrated in new designs at the cost of a small amount of weight and power consumption.

Figure 2:
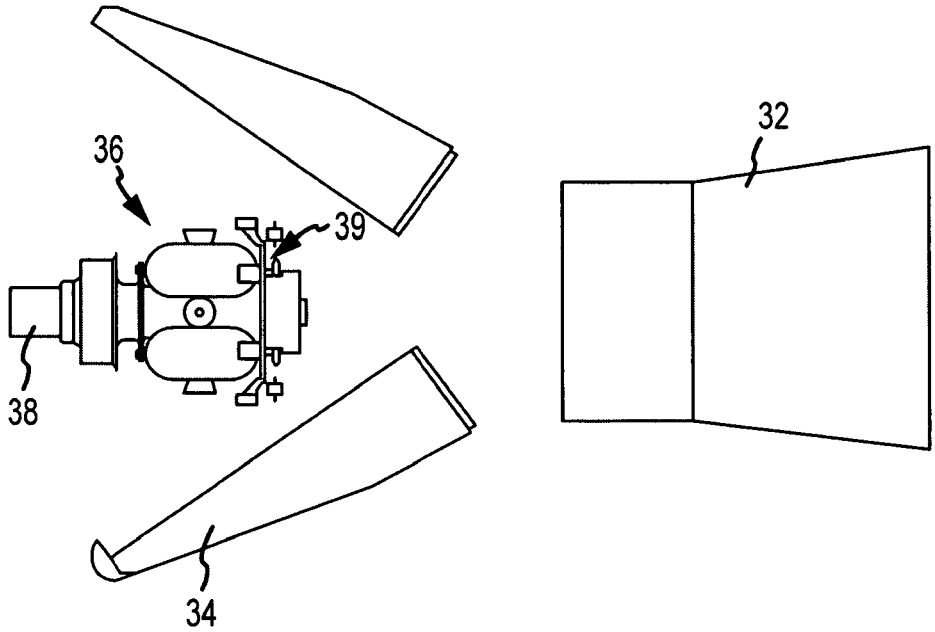
FIG. 2 is a diagram of the upper stage of the rocket including a representative interceptor kill vehicle.
Figure 3:
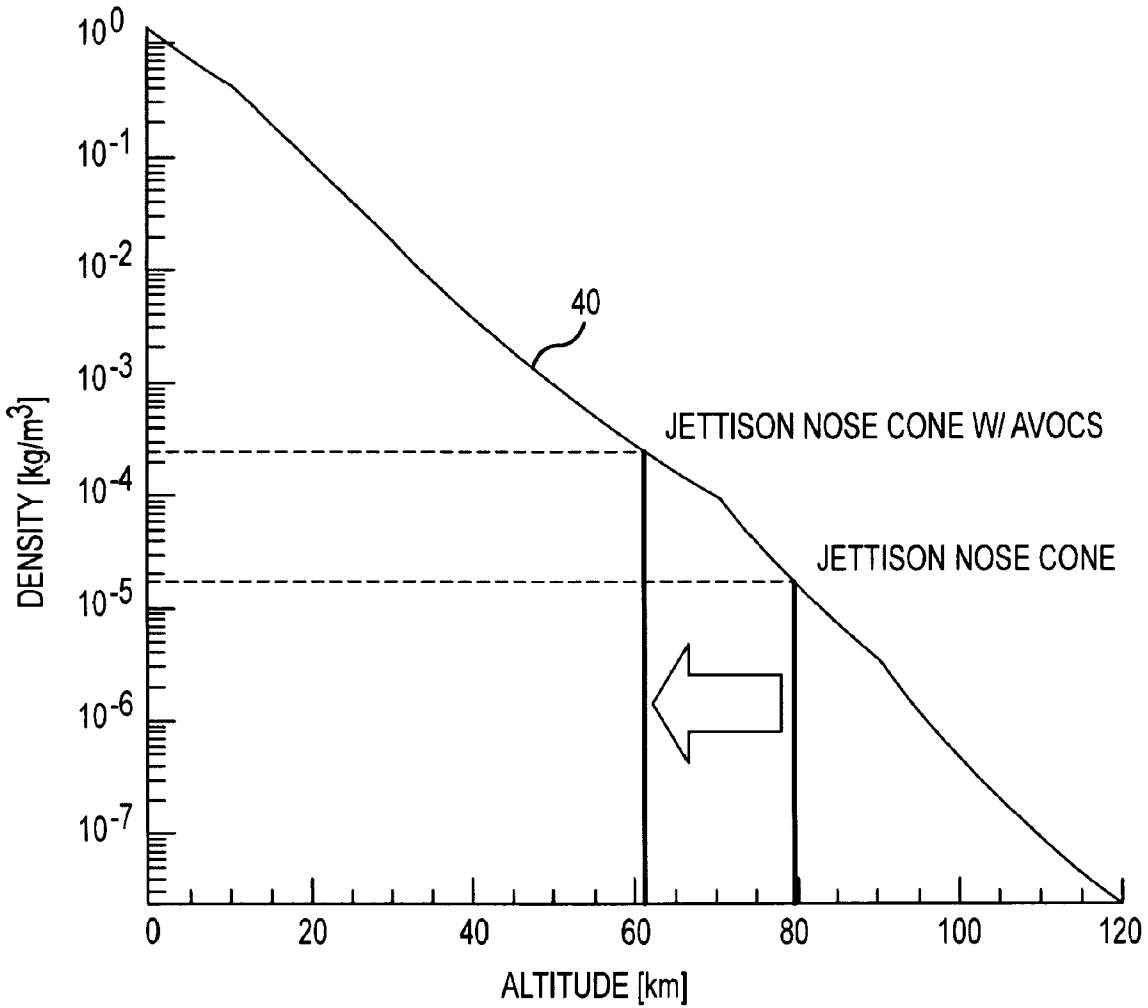
FIG. 3 is a diagram of atmospheric density vs. altitude comparing tracking start points with and without the proposed AVOCS.
Figure 4:
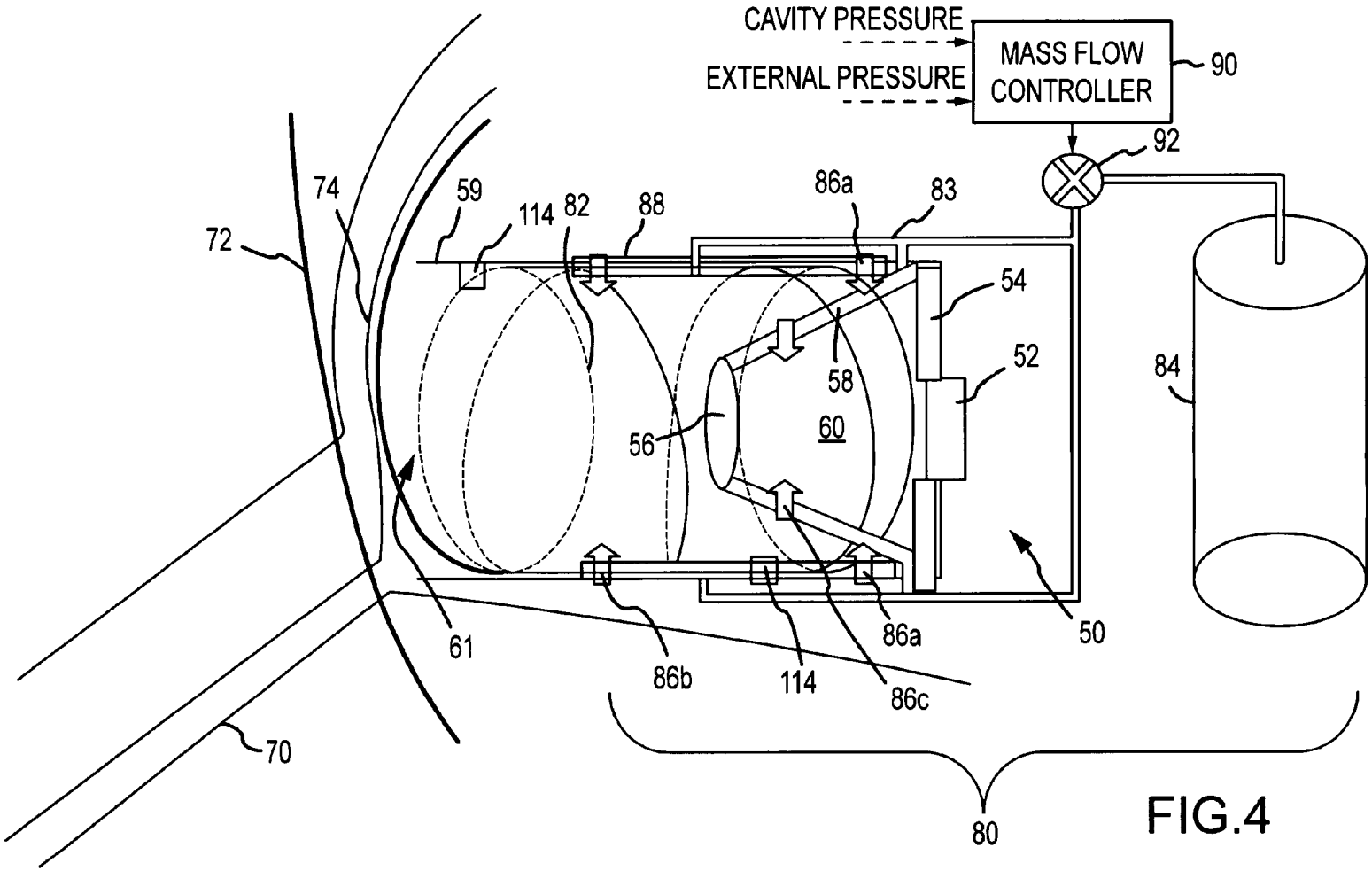
FIG. 4 is a block diagram of an AVOCS implemented in a generic kill vehicle system with tiered embedded EO structures.
Figure 5:
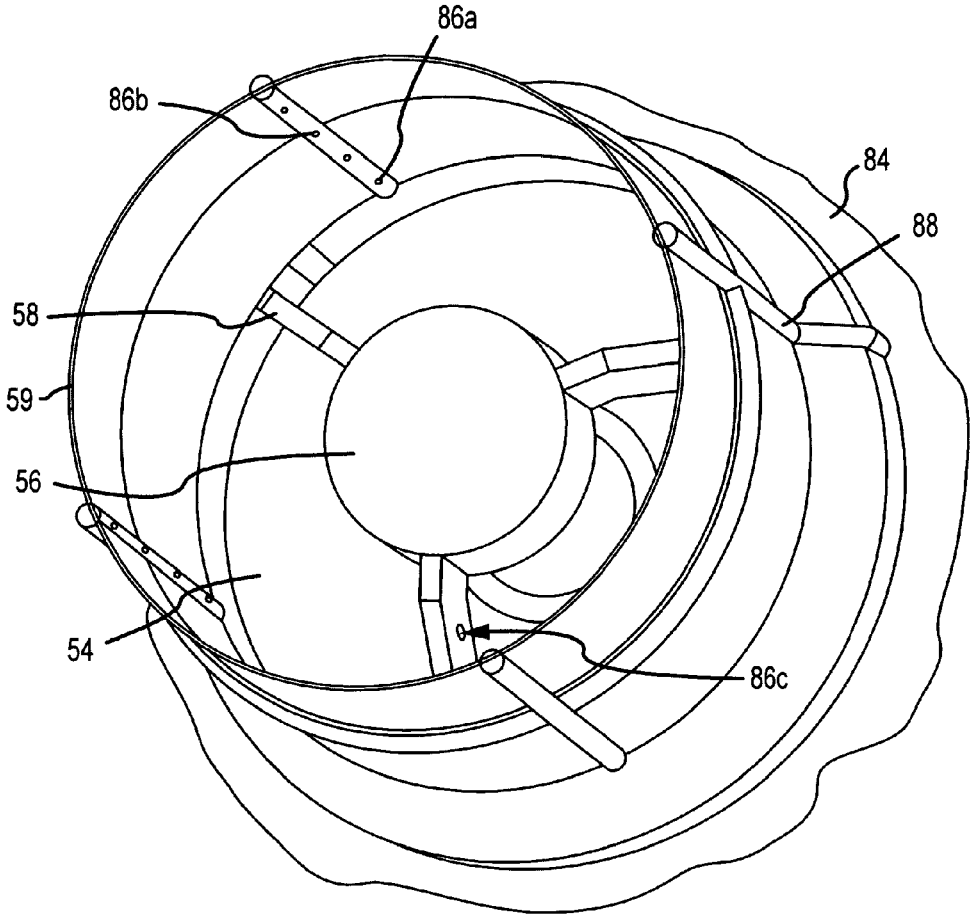
FIG. 5 is a perspective view of the AVOCS around the forward-facing structure.
Figure 6:
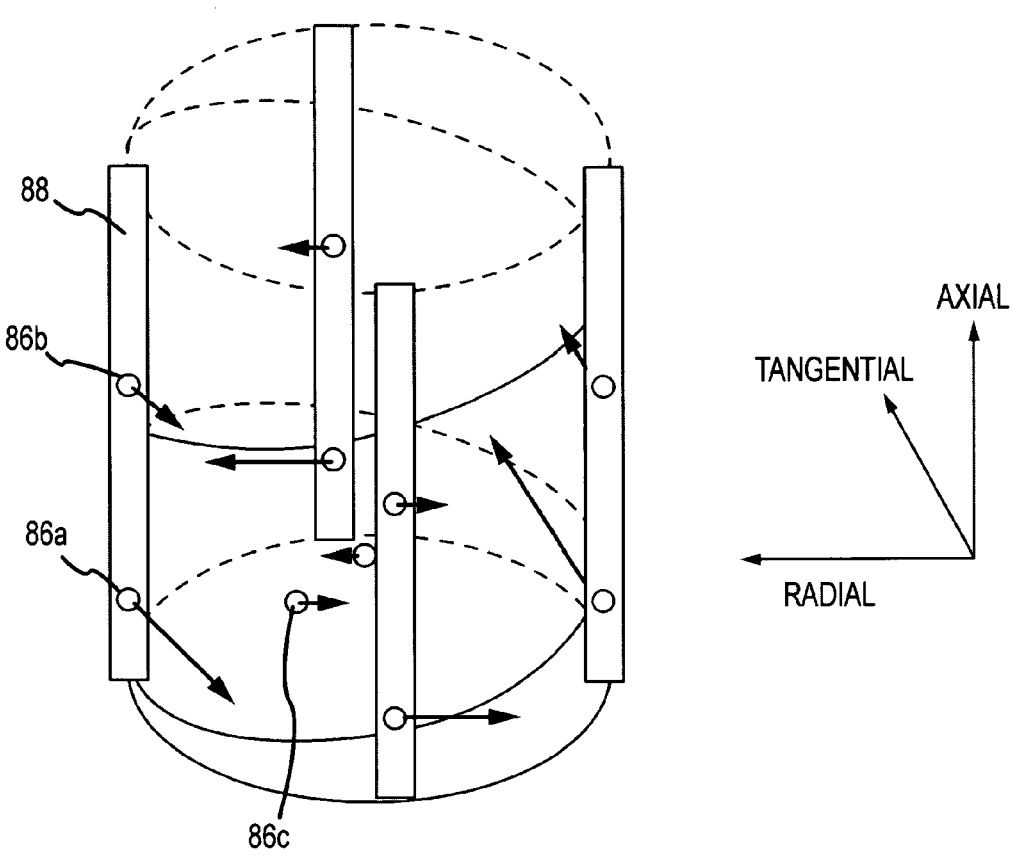
FIG. 6 is a diagram of the AVOCS injectors positioned in the cavity to create and maintain the coherent vortex as it advances.

As shown in FIGS. 1-3, a hostile missile 10 is launched on a ballistic trajectory 12 towards a friendly target. The warhead 14 separates from the boost stage 16 and often releases decoys, chaff, etc. 20 that form a target cloud 20 around one or more re-entry vehicles RVs (targets) 18. Missile launch can generally be divided into a number of phases commencing with the boost phase of main rocket burn, ascent phase up to booster separation, pre-deployment phase when targeting maneuvers are performed, deployment phase when the RV and decoys are released, early mid-course in full flight to the their targets and descent. The RV and decoys may deviate from this trajectory either unintentionally upon re-entry into the atmosphere or intentionally to defeat a missile defense system. The missile defense system may be configured to intercept the RVs at any of these stages.

A missile defense system includes a number of external systems e.g. satellites 22, radar installations 24, other sensor platforms, etc that detect missile launch, assess the threat, and determine external target cues (ballistic trajectory, time to intercept, number of RVs, etc.). The defense system engages a silo (or silos) 26 to initiate power up, perform the built-in test (BIT) of the interceptor and load mission data prior to launch. The silo ignites the $1^{st}$ stage booster to launch interceptor 28 along an initial intercept track 30 based on those external target cues. The interceptor may be suitably tracked by a ground based radar installation 24 and engages it's divert and ACS systems to put the interceptor on the initial intercept track. As the interceptor ascends along its exo-atmospheric trajectory at supersonic speeds, a superheated shock wave develops in front of the interceptor. A nose cone 34 protects the KV 36 and sensitive EO sensors and optical components of the passive sensor system located inside the cavity within sun shade 38 from the superheated air but prevents data gathering. Ground station 31 continues to gather information from satellites 22, radar installations 24, and other sensor platforms to get up to date information on the position of the target cloud, target discrimination information etc. and uplink updated mission plans to the interceptor for the booster and KVs.

Once aloft, the interceptor drops the 1$^{st}$ and any additional booster stages 32. Just prior to jettisoning the nose cone 34, the flight controller commands the AVOCS on board the KV 36 (or each KV in an mKV configuration) to initiate gas injection to create a vortex inside the cavity within sun shade 38 in front of the passive sensor system. The flight controller may be configured to initiate gas injection at a predetermined time after launch, a preset altitude or at an estimated time to intercept. This 'triggering' functionality may be incorporated in the mass flow controller itself. For example, in a retrofit design, it may be more convenient or necessary to keep the functionality separated.

As shown in plot 40 in FIG. 3, the density of air drops approximately exponentially with increasing altitude. Conventional systems can drop the nose cone and initiate EO imaging at approximately 80 km. Even considering the strict weight and power budget issues of any interceptor, AVOCS can provide a protective vortex starting appreciably lower, only limited by the total mass of gas carried. If released at approximately 60 km, the device provides several seconds until the vehicle reaches 80 km. The additional seconds of EO imaging may shift initial acquisition from the deployment to the pre-deployment phase or from the ascent to the boost phase depending on the threat and missile defense system configuration. The flight controller, guidance and other systems process the imagery to alter the intercept trajectory.

As illustrated in FIGS. 4-7, a KV includes a passive sensor system 50 configured to image a determined target volume of a target cloud and provide discrimination to support tracking of possible targets and potentially assignment of targets. The details of the interceptor, KV and specifically the KV passive sensor system are beyond the scope of the present invention. A simplified system sufficient to illustrate the principles of operation of the AVOCS will be described. Passive sensor system 50 includes a one or two color focal plane array (FPA) 52 that provides a passive LWIR sensor. A one color FPA is adequate to resolve objects and intercept an assigned target. The second color allows the KV to eliminate simple decoys as non-credible. The optical system for imaging the target cloud onto FPA 52 comprises a primary mirror 54 and a secondary mirror 56 supported by struts 58. Primary mirror 54 has an annular shape through which light reflecting off the secondary mirror from the primary mirror enters FPA 52. The FPA is coupled to sensor electronics and to a digital video cable that carries video sensor data back to the guidance unit. A protective cover 59 such as a sunshade on the KV platform covers the optical system and FPA. The cover physically protects the components and, in this case, blocks stray light from entering the optical system. The cover may also provide structural stiffness, absorb external electromagnetic signals, act as a ballast etc. The cover 59 defines a cavity 60 having an opening 61 to the external environment of Earth atmosphere that allows the EO sensors to "see" in the direction the KV is pointed to image the threat cloud.

When the KV reaches a sufficiently high altitude, the flight controller jettisons the nose cone and the cavity is exposed to the free stream 70. These sensor systems are attached to the main body of the KV and their line of sight (LOS) to the target may be offset to the free stream velocity vector of the free stream. The bow region of a supersonic vehicle is dominated by a shock 72 that transforms the oncoming high speed free stream to subsonic velocities. The flow 70 crosses the shock 72, the gas heats up, and then, absent the AVOCS of the current invention, the heated external flow field 74 would penetrate the cavity 60 through the windward side of the sun shade 59. Here, the hot gas would make contact with the optical components and their mounting structures. The steady state flow becomes unstable within the cavity. The recirculating hot gases would heat up the critical components, and then make their way out of the cavity through the leeward gap between the shock 72 and rim of the sunshade 59.

In accordance with the present invention, the passive sensor system 50 is provided with an Active Vortex Control System (AVOCS) 80, either as part of an integrated design or a retro-fit, that injects gas into the cavity 60 to generate a vortex 82 in front of and possibly around the components that interferes with the heated external flow field 74 in the opening to protect the components from the external environment. The vortex blocks the external flow field pushing it off to the leeward side of the sun shade 59. The injected gas also vents through the opening. The vortex has a secondary benefit of being able to cool critical components through convection and/or vortex cooling without the use of a refrigerant. Placement of injectors near critical components stabilizes the vortex near the components, thereby potentially providing spot cooling.

AVOCS 80 includes injection manifold lines 83 that carry gas from a storage bottle 84 to primary injectors **86*a* formed in hollow struts 88 to inject gas into the cavity 60 to generate vortex 82. A mass flow controller 90 controls a regulator 92 to regulate the flow of gas into the cavity to maintain the coherence of the vortex with sufficient strength to block the external flow fields Storage bottle 84 is suitably shared with other KV systems to conserve weight and space, shown here as a toroidal bottle around the base of the sun shade. In this application, the gas must be sufficiently optically inert within the band of interest imaged by FPA 52. Argon, Nitrogen and Xenon gases are typically provided on the KV and are optically inert within the IR band. These gases suitably have a higher molecular weight than the external flow field. The hollow struts may be mounted inside the cavity or integrated into the walls of sun shade 59**. The former being more suitable to a retro-fit application and the latter to a new design as integration reduces interference with the vortex.

A set of four primary injectors **86*a* are spaced along an inner periphery of the cavity approximately ninety degrees apart near the components. In general, the number, spacing and overall configuration of the primary injectors will depend on the cavity, components within the cavity and external flow fields. Each injector injects gas having all three velocity components: tangential towards the cavity surface; inward radial towards the cavity axis; and axial, advancing along cavity axis towards the opening. The offset angle is variable, but common ranges are 8-25 degrees off tangential. Pure inward injection produces no rotation while pure tangential injection produces significantly reduced cavity flow penetration. Optimal design through angled input flow provides reduced energy loss through lowered gas impingement on exterior walls. In the same optimized design vein, injectors should be aimed towards the opening 61 to create a stronger vortex. However, since the cavity often has a specific location (leeward side of opening 61**) for the flow to exit, the cavity will still fill with injected gas eventually.

Every time the gas strikes the inner walls of the sun shade, the optical components or the support structure, the gas loses energy. It is very important that the coherence (spinning shape) of the vortex be maintained to block the external flow fields. One option is to inject a lot of gas to create a very strong vortex that can withstand the impact losses. A more efficient approach is to add angular momentum at the loss points to retain the swirling action. Additional sets of secondary injectors 86*b* and 86*c* may be placed along the inner periphery of the cavity towards the opening and/or placed on internal structure (components or supporting structure), respectively. More than one layer of secondary injectors 86*b* may be placed along the inside of the cavity. As these injectors are merely maintaining, not creating, the vortex, the injected flow rates can be much smaller than the primary injectors, maybe 10-20%. This can be accomplished either by the design of the vortex to inject a reduced mass flow or through a different manifold and tubing configuration. The rotating fluid stabilizes the flow and eliminates any random oscillations of the stagnant gas. The rotating inflow boundary conditions result in a strong solution to the Navier-Stokes equations. This addition collapses multiple potential answers from plain stagnation flow running opposite to the external flow into a single solution. These weak stagnation solutions exist even if the momentum and pressure requirements are fulfilled. The resulting strong flow stability enables the corresponding low mass injection rate.

The AVOCS must inject gas at a mass flow rate sufficient to create and maintain a vortex capable of interfering with the external flow field to keep it away from the components. Ideally, the vortex produces (a) a cavity pressure approximately equal to or greater than the free stream Pitot pressure of the external flow field, (b) a linear momentum approximately equal to or greater than the momentum of the external flow field and (c) an angular momentum sufficient to maintain coherence of the vortex. This is derived through the rotating inflow boundary condition. Satisfaction of all three conditions ensures that the vortex will completely block the external flow fields from entering the cavity. However, to conserve both gas and energy the vortex may be designed and the conditions relaxed to allow the external flow fields to enter the cavity but be kept away from critical components or to enter and reach the components but for such a brief period of time there is no damage.

The three components of the vortex serve different yet complementary roles. Maintaining a cavity pressure greater than the Pitot pressure is analogous to creating 'positive pressure' within the cavity. The Pitot pressure is the stagnation pressure of the external environment equal to the sum of the static and dynamic pressures. The linear momentum constraint can bethought of as a fire hose with sufficient strength to push back the external flow field. The angular momentum is the product of the linear momentum and the cavity radius. To maintain coherence, the spatial and temporal self-coherence (autocorrelation) of the spinning gas must remain high with a time constant greater than the relative closing velocity between the cavity and the external environment. Even if the cavity pressure and linear momentum constraints are satisfied, if coherence is lost the external flow field can push the gas to the side and reach the components.

Figure 7A:
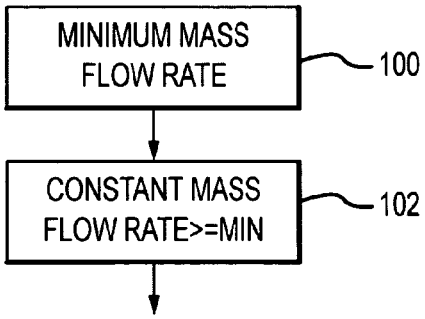
FIGS. 7*a* through 7*c* are flow diagrams of alternate embodiments of the mass flow control to maintain the coherent vortex.
Figure 7B:
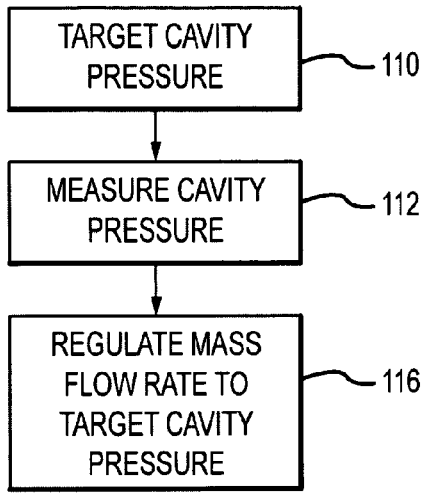
Figure 7C:
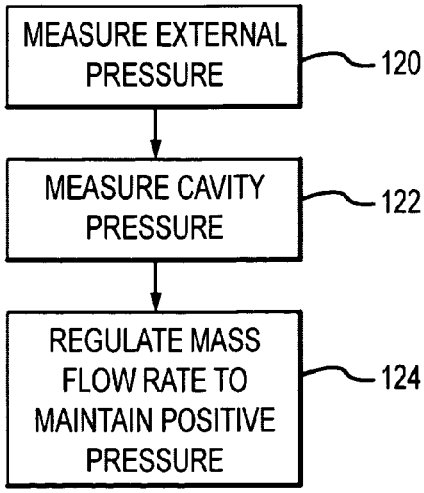

As shown in FIGS. 7*a* through 7*c*, these different approaches can be achieved by maintaining a constant mass flow at or above a minimum required flow, regulating the mass flow to maintain a target cavity pressure or regulating the mass flow to maintain a positive pressure inside the cavity, respectively. The mass flow controller is programmed to execute a method to control the regulator to regulate the mass flow rate. The simplest but least efficient approach determines a minimum mass flow rate to protect the components (step 100) and than maintains a constant mass flow rate at or above the minimum (step 102) for a certain period of time, to perform a certain maneuver or until all of the gas is expended. This is the easiest approach but tends to waste a lot of gas because the external flow fields typically change over time. Another approach is to determine a target cavity pressure (step 110), measure the pressure inside the cavity (step 112) using sensors 114 inside the cavity and regulate the mass flow rate to maintain the target cavity pressure (step 116). Yet another approach is to measure the external pressure (step 120) by, for example, measuring the altitude, measure the internal cavity pressure (step 122) and regulate the mass flow rate to maintain a positive pressure (step 124). The latter approaches are more efficient as they adapt to changing conditions but require sensing one or more environmental conditions and adjusting the mass flow rate. As mentioned above each of these three approaches (and there may be others) can be configured to satisfy all three ideal conditions or to relax one or more of the conditions. It is not necessary that each condition be satisfied 100%; lower coverage produces fairly linear performance degradation. To conserve both gas and energy, the conditions may be relaxed to allow the external flow fields to partially enter the cavity but be kept away from critical components or to enter and reach the components but for such a brief period of time there is no damage.

Figure 8:
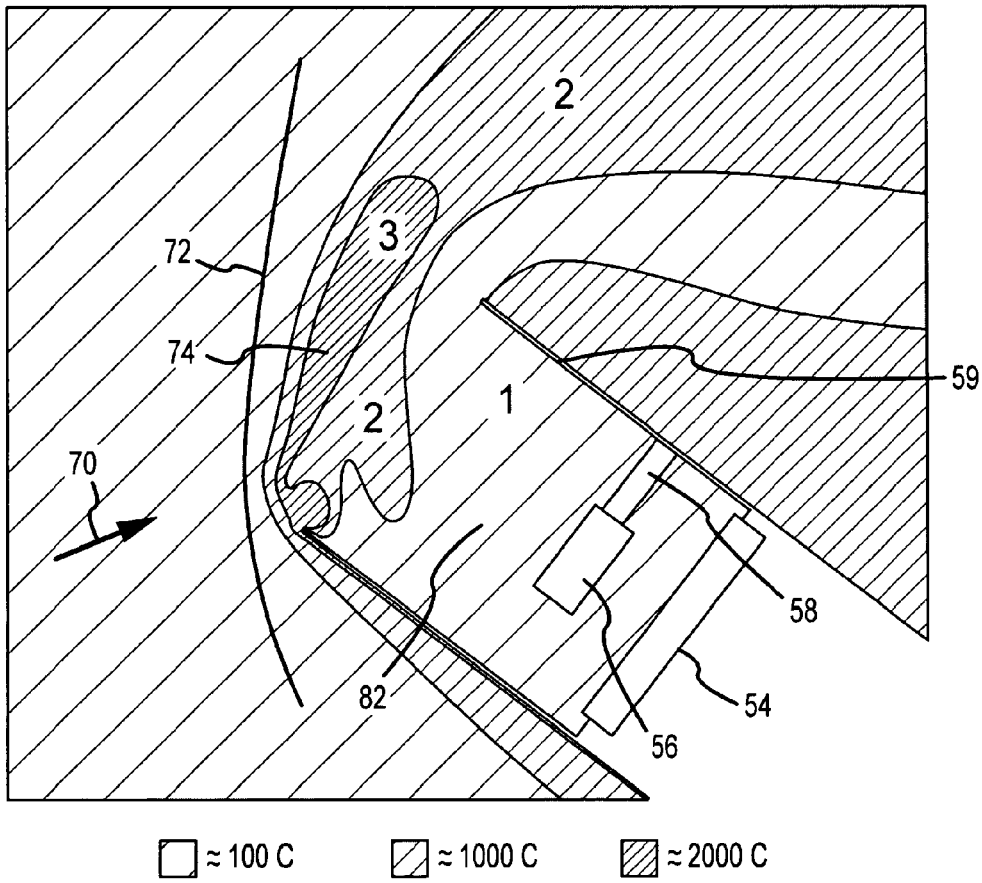
FIG. 8 is a simulated plot of temperature behind a supersonic shock and within the cavity when the AVOCS system is operational.

FIG. 8 is a diagram of the thermal gradients experienced at the bow of a supersonic KV and inside the protected cavity. The cold, medium and hot temperatures ranging from approximately 100 to 2000 degrees Celsius are labeled as regions 1, 2 and 3, respectively. The AVOCS generates a low-temperature vortex 82 from the injected gas that fills the cavity. The bow region of a supersonic vehicle is dominated by shock 72 that transforms the oncoming high speed free stream 70 to one with a subsonic velocity. The flow 70 crosses the shock 72 and the gas heats up creating heated post shock response 74. The created vortex 82 blocks the external flow field 74 and pushes it off to the side of sun shade wall 59. The injected gas also vents through the opening. In this configuration, the three conditions are approximately satisfied, completely blocking the hot gas in region 3 from entering the cavity. The primary and secondary mirrors 54 and 56, respectively, and support structure 58 are surrounded by cold gas in region 1 and effectively isolated from the heated external free stream. If the conditions on the vortex were relaxed somewhat, the hot gas in region 3 could be allowed to penetrate the edges of the cavity but be kept away from the components. If the conditions were relaxed even further, the hot gas in region 3 could be allowed to "pulse" deep into the cavity even reaching the components. However, the exposure time of the pulse would be so short that no damage was done to the components. The relaxed conditions are more complicated to ensure adequate protection of the components but do significantly reduce the amount of gas required.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. An active vortex control system (AVOCS) to protect components from an external environment, comprising:

a protective cover, said cover defining a cavity having an opening to the external environment;

one or more components inside the cavity; and a gas canister and one or more injectors configured to inject gas into the cavity with tangential and inward radial velocity components to generate a coherent vortex in front of the one or more components and an axial velocity component that causes the vortex to advance towards the opening to interfere with an external flow field in the opening;

further comprising a mass flow controller configured to inject gas at a mass flow rate such that said vortex produces a cavity pressure approximately equal to or greater than the free stream Pitot pressure of the external flow field, a linear momentum approximately equal to or greater than the momentum of the external flow field and an angular momentum to maintain coherence of the vortex.

2. The AVOCS of claim 1, wherein the external flow field comprises a moving air stream.

3. The AVOCS of claim 1, wherein the external flow field comprises diffusion or outgassing.

4. The AVOCS of claim 1, wherein said one or more injectors comprise a plurality of said injectors spaced around an inner periphery of the cover that each inject gas with both tangential and inward radial velocity components and said axial velocity component.

5. The AVOCS of claim 1, wherein the said one or more injectors comprise:

a first set of injectors that inject gas at a first mass flow rate to create the vortex in the cavity; and a second set of injectors between said first set and said opening that inject gas at a second lower mass flow rate to maintain the coherence of the vortex.

6. The AVOCS of claim 1, wherein at least one said injector is positioned near a component to stabilize the vortex to cool said component.

7. The AVOCS of claim 1, further comprising:

a regulator that regulates the mass flow rate of gas from the canister to the injectors; and a mass flow controller that controls the regulator to deliver a constant mass flow rate that is set at or above a minimum mass flow rate required to protect the components.

8. The AVOCS of claim 1, further comprising:

a regulator that regulates the mass flow rate of gas from the canister to the injectors;

one or more sensors that measure the internal cavity pressure; and a mass flow controller that controls the regulator to maintain the internal cavity pressure at a target pressure.

9. The AVOCS of claim 1, further comprising:

a regulator that regulates the mass flow rate of gas from the canister to the injectors;

one or more sensors that measure the internal cavity pressure;

a sensor that provides a measure of external pressure; and a mass flow controller that compares the internal cavity pressure and external pressure to control the regulator to maintain a positive pressure inside the cavity.

10. An active vortex control system (AVOCS) to protect components residing inside a cavity defined by a protective cover from an external environment, said cover having an opening from the cavity to the external environment, said AVOCS comprising:

a gas canister; and a plurality of injectors spaced around an inner periphery of the protective cover that each inject gas with both tangential and inward radial velocity components to generate a coherent vortex in front of the one or more components and an axial velocity component that causes the vortex to advance towards the opening to interfere with an external flow field in the opening;

further comprising a mass flow controller configured to inject gas at a mass flow rate such that said vortex produces a cavity pressure approximately equal to or greater than the free stream Pitot pressure of the external flow field, a linear momentum approximately equal to or greater than the momentum of the external flow field and an angular momentum to maintain coherence of the vortex.

11. The AVOCS of claim 10, wherein the plurality of injectors comprise:

a first set of injectors that inject gas at a first mass flow rate to create the vortex in the cavity; and a second set of injectors between said first set and said opening that inject gas at a second lower mass flow rate to maintain the coherence of the vortex.

12. The AVOCS of claim 11, wherein at least one said injector is positioned near a component to stabilize the vortex to cool said component.

13. A method of protecting components residing, inside a cavity defined by a protective cover from an external environment, said cover having an opening from the cavity to the external environment, comprising:

injecting gas into the cavity with tangential and inward radial velocity components to generate as coherent vortex in front of the one or more components and an axial velocity component that causes the vortex to advance towards the opening to interfere with an external flow field in the opening;

wherein the step of injecting gas into the cavity comprises injecting gas at a mass flow rate such that said vortex produces a cavity pressure approximately equal to or greater than the free stream Pitot pressure of the external flow field, a linear momentum approximately equal to or greater than the momentum of the external flow field and an angular momentum to maintain coherence of the vortex.

14. The method of claim 13, wherein the step of injecting gas into the cavity comprises:

injecting gas at a plurality of locations spaced around an inner periphery of the cover with tangential and inward, radial velocity components that generate the vortex and the axial velocity component that causes the vortex to advance towards the opening.

15. The method of claim 13, wherein gas is injected near a component to stabilize the vortex to cool said component.

16. The method of claim 13 wherein the step of injecting gas into the cavity comprises:

regulating the mass flow rate of gas to deliver a constant mass flow rate that is set at or above a minimum mass flow rate required to protect the components.

17. The method of claim 13, wherein the step of injecting gas into the cavity comprises:

sensing an internal cavity pressure; and regulating the mass flow rate to maintain the internal cavity pressure at a target pressure.

18. The method of claim 13 wherein the step of injecting gas into the cavity comprises:

sensing an internal cavity pressure;

sensing an external pressure; and comparing the internal cavity pressure and external pressure to regulate the mass flow rate to maintain a positive pressure inside the cavity.

* * * * *